United States Patent [19]

Underwood

[11] Patent Number: 4,907,384

[45] Date of Patent: Mar. 13, 1990

[54] PANEL CONNECTION ARRANGEMENT FOR A PARTITION SYSTEM

[75] Inventor: Robert A. Underwood, Huntingburg, Ind.

[73] Assignee: Kimball International, Inc., Jasper, Ind.

[21] Appl. No.: 219,995

[22] Filed: Jul. 15, 1988

[51] Int. Cl.[4] ..... E04B 2/74

[52] U.S. Cl. ..... 52/126.6; 52/239; 52/220

[58] Field of Search ..... 52/239, 126.3, 126.4, 52/284, 285, 286, 582, 300, 36, 241

[56] References Cited

U.S. PATENT DOCUMENTS

| | | | |
|---|---|---|---|
| 3,999,353 | 12/1976 | Dielman | 52/126.4 |
| 4,035,972 | 7/1977 | Timmons | 52/241 |
| 4,250,676 | 2/1981 | Presby | 52/239 |
| 4,269,005 | 5/1981 | Timmons | 52/36 |
| 4,450,658 | 5/1984 | Legeai | 52/126.3 |
| 4,567,698 | 2/1986 | Morrison | 52/36 |
| 4,625,483 | 12/1986 | Zackey et al. | 52/582 |

FOREIGN PATENT DOCUMENTS

| | | | |
|---|---|---|---|
| 2060022 | 4/1981 | United Kingdom | 52/300 |

*Primary Examiner*—David A. Scherbel
*Assistant Examiner*—Michele Van Patten
*Attorney, Agent, or Firm*—Albert L. Jeffers; John F. Hoffman

[57] ABSTRACT

A panel connection apparatus useful in a multi-panel system includes features which improve the rigidity and simplicity of construction and ease of installation of the panel system. The features of the panel connection apparatus relate to a panel top cap assembly, a panel interlock assembly and panel top and bottom connector assemblies which interconnect and support frame structures of adjacent panels at adjacent portions of their top and bottom edges and opposite side edges.

40 Claims, 3 Drawing Sheets

PANEL CONNECTION ARRANGEMENT FOR A PARTITION SYSTEM

BACKGROUND OF THE INVENTION

The present invention generally relates to office partition systems and workstation construction and, more particularly, is concerned with a multi-panel system having a panel connection system.

It is conventional practice to employ multi-panel systems to divide and arrange office space into separate workstations. The multi-panel systems typically incorporate a number of large generally planar-shaped modular panels and hardware for connecting the panels end-to-end. The connected panels provide free-standing wall units which serve as partitions and, in turn, support other office furnishings, such as shelves and desks.

Representative of multi-panel systems found in the prior art are the ones disclosed in U.S. Patents to Timmons (4,269,005), Morrison (4,567,698) and Zacky et al (4,625,483). While many multi-panel systems of the prior art appear to generally achieve their particular design objectives, most embody several drawbacks which make them less than an optimum panel system.

Many of the multi-panel partition systems rely on features, such as grooves or channels, built into the structure of the panels to align and connect panels together. Such features tend to make manufacture of the panels more complex and costly. Also, most of the multi-panel systems have height-adjustable support pedestals mounted adjacent to respective opposite lower corners of each panel which are used for leveling the panel system. As the panels are being connected together during installation, the adjacent pedestals on respective connected panels have to be adjusted to the same height more or less concurrently in order to avoid potential binding and damage to the connecting components and to provide a wall which is level. This makes installation of the multi- panel system more time-consuming, difficult and tedious to carry out. Further, many multi-panel systems employ structurally inadequate components between the vertical edges of the connected panels for supporting in cantilevered fashion other workstation components, such as shelves, cabinets and work surfaces. The inadequacy of these components can contribute to panel sagging and misalignment.

A further drawback to many prior art partition systems of this general type is the lack of rigidity in the connection between adjacent panels, which results in an overall system which is wobbly and unstable. In some cases, the individual panels themselves lack rigidity, and when this is combined with a poor connection system between adjacent panels, an unacceptable partition system results.

A further drawback of many prior art systems is that the panels can be inserted in only one way with one side of the panel facing outwardly and the other facing inwardly. If a panel is designed with one type of surface on one side, such as fabric, and another type of surface on the other side, such as a wood-grain or other type of non-fabric surface, the proper type of surface must be put on each side of the panel at the factory. If this is not done correctly, then the panel will be reversed, and this fact may not be discovered until the system is being assembled at the job site. Accordingly, a panel system wherein the individual panels are reversible is of significant advantage.

Consequently, a need still exists for panel connection system which is rigid, quick, easy and simple to install and eliminates the above-mentioned drawbacks of prior multi-panel systems.

SUMMARY OF THE INVENTION

The present invention provides a panel connection system designed to satisfy the aforementioned needs. The connection system of the present invention makes it easy to set up and level the panels as they are installed and, conversely, makes it easy to change the panel arrangement. Also, the connection system minimizes the number of parts needed to be assembled and adjusted during installation of a multi-panel system, provides for automatic and accurate alignment of the panels, and achieves reliable and rigid connections of the panels together. Further, the apparatus has built-in features which serve to alert the installer if fastening of all components of the panel connection system has not been completed.

The panel connection apparatus of the present invention encompasses several different features useful in a multi-panel system. Although these features of the panel connection system are advantageously incorporated together to realize their overall benefits, improvement of multi-panel system construction can also be obtained by employment of certain of the features separately.

The multi-panel system in which the features of the panel connection apparatus are useful includes panels each having a frame structure with top and bottom edges and opposite side edges. The features of the panel connection apparatus generally relate to a panel top cap assembly, panel top and bottom connector assemblies and panel interlock assembly.

The top cap assembly of the panel system includes a decorative cap member which is frictionally connected to a connector member that spans between adjacent panels so as to rigidly interconnect the panels and ensure proper alignment. This avoids a disadvantage that is present in many prior art panel systems wherein adjacent panels are connected to each other along their edges or are connected to a common post where there is no interconnection member that extends horizontally to provide the desired alignment.

More particularly, the top cap retainer member of one form of the invention includes a pair of spaced downwardly projecting flanges extending longitudinally of the cap retainer member. The attachment member includes a pair of upwardly projecting flanges extending longitudinally of the attachment member. The lower edges of the retainer member flanges are generally in-turned, whereas the upper edges of the attachment member flanges are generally out-turned such that the respective edges define cam surfaces which engage and cause yieldably flexing of the flanges of the resiliently flexible one of the retainer and attachment members for achieving the frictional interfitting of the flanges with one another.

In order to provide for an extremely rigid connection between one panel and an adjacent panel, the connection system includes a connector member that spans between adjacent panels and has a very tight interference fit with brackets connected to the top edges of the adjacent panels. When the connector member is clamped against the U-shaped brackets by means of threaded fasteners, the adjacent panels are accurately aligned and rigidly held against any movement in directions normal to the planes of the panels.

Each of the panel top and bottom connector assemblies of the panel connection apparatus according to a preferred embodiment includes a pair of panel bracket members adapted for attachment upon adjacent portions of the top edges of the panels, and the panel connector member of the top cap assembly is adapted for interengagement within and rigid attachment to the panel bracket members so as to span therebetween and rigidly interconnect and accurately align the panels with one another. Further, each of the panel bracket members of the top and bottom connector assemblies includes a pair of spaced flanges and each panel connector member of each of the top and bottom connector assemblies includes a pair of spaced flanges. The spacing between the flanges of the respective pairs thereof is such that the panel connector member is adapted to insert in a nested relation within the panel bracket members with the connector member flanges with an interference fit. The flanges of either the connector member or the bracket member are resiliently yieldable for permitting yieldable flexing thereof to achieve insertion of the connector member.

The bottom panel connector assembly located at the bottom edges of the panels includes a pedestal coupled to the connector member. The pedestal extends downwardly therefrom for engaging a support surface, and is adjustable relative to the connector member for leveling the panels relative to the support surface.

The panel interlock assembly of the panel connection apparatus according to one form of the invention includes a pair of vertical channel members each connected to a respective panel side edge and having interconnected walls defining respective first and second diagonally opposite corner portions, the first and second corner portions of one channel member being interfittable with the second and first corner portions of the other channel member by merely moving the side edge of one panel toward the adjacent side edge of the other panel. A pair of clamp members, one being attached to a bottom side of the connector member of the top connector assembly and projecting downwardly therefrom and the other being attached to a top side of the connector member of the bottom connector assembly and projecting upwardly therefrom, are interfittable within the respective open top and bottom ends of the channel defined in the vertical channel members and clamp and retain the respective corner portions of the channel members at their respective interfitted relation with one another.

More particularly, each of the walls of the second pair thereof of the channel members has a row of holes defined therein for receiving a hanger for supporting an object therefrom. The channel members include respective middle walls which extend generally across the middle of the channel and overlap with one another so as to block passage of light through the holes in the channel members and across the channel therein.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
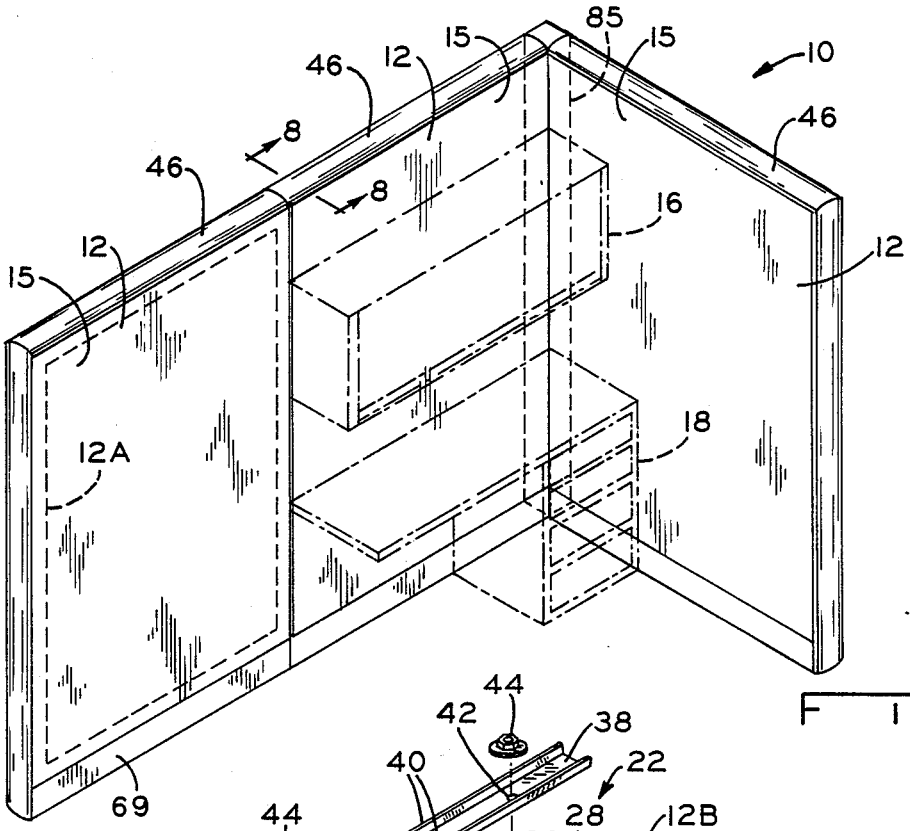
FIG. 1 is a perspective view of a multi-panel system employing panel connection apparatus in accordance with the principles of the present invention.
Figure 2:
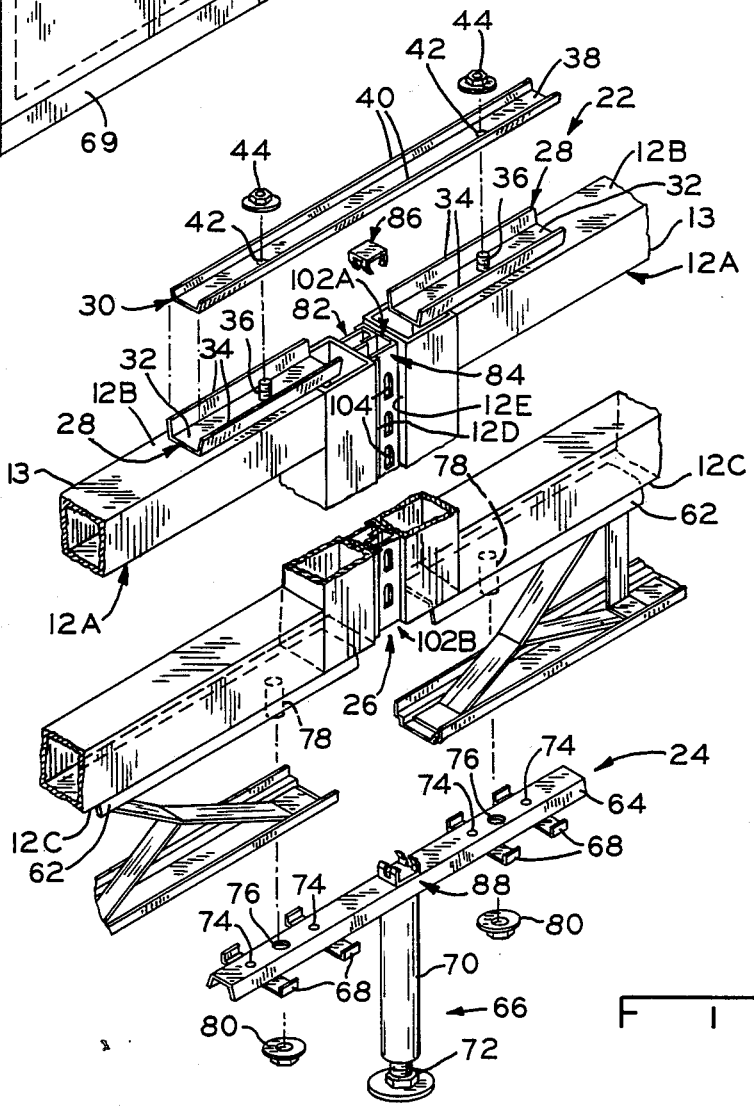
FIG. 2 is an exploded perspective view of the panel connection apparatus in conjunction with a pair of panels being shown in fragmentary form with portions broken away and vertically foreshortened.
Figure 3:
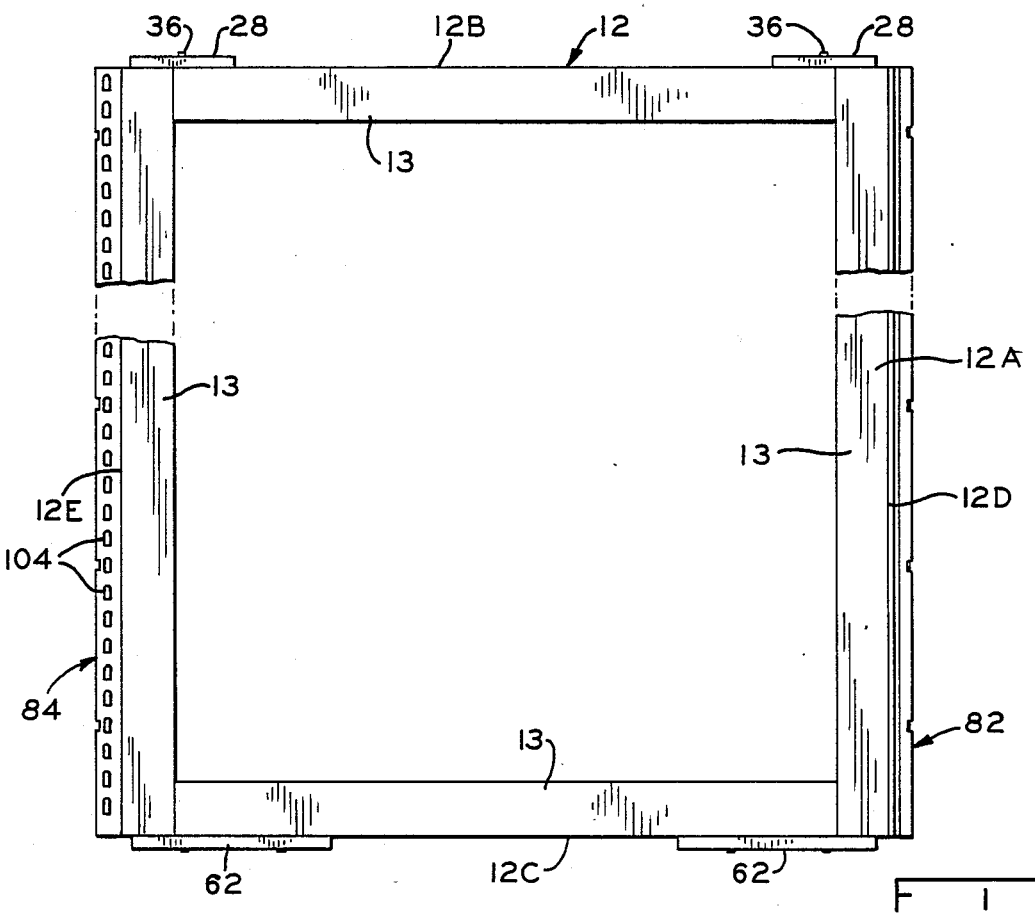
FIG. 3 is a side elevational view, in vertically foreshortened form, of one panel of the multi-panel system of FIG. 1, with some of the components of the panel connection apparatus of FIG. 2 being mounted on the panel.
Figure 4:
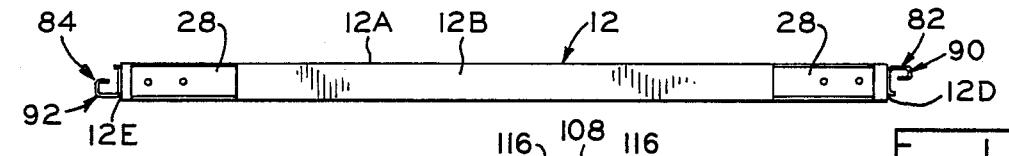
FIG. 4 is a top plan view of the panel of FIG. 3.

Referring now to the drawings, and particularly to FIGS. 1 and 2, there is shown in FIG. 1 a multi-panel assembly, generally designated 10, which employs a plurality of modular panels 12 rigidly held together along each of their adjacent vertical edges by a panel connection apparatus, generally indicated as 14 in FIG. 2. Also illustrated in FIG. 1 in phantom outline are modular workstation components or accessories such as a shelf 16 and a worksurface 18 which are supported by parts of the panel connection apparatus 14 as will be described hereinafter. Each panel 12 has a generally planar-shaped frame structure 12A comprising a plurality of rectangular steel tubing members 13 that are welded together to form a rectangular frame as shown in FIG. 3. Tubing members 13 are relatively massive and, when they are welded together to form a rectangular frame 12A, form a structure which is extremely rigid and forms the structural base to which the fabric or other type of skin 15 is attached. Frame 12A includes top and bottom edges 12B, 12C and opposite side edges 12D, 12E. In accordance with the present invention and the panel connection apparatus 14 includes a panel top cap assembly 20 (FIG. 8), panel top and bottom connector assemblies 22, 24 (FIG. 2) and a panel interlock assembly 26 having components which respectively mount to and interconnect the top, bottom and side edges 12B–12E of the panels 12.

More particularly, referring to FIGS. 2 and 6–8, the panel top connector assembly 22 of the panel connection apparatus 14 includes a pair of panel bracket members 28 and a panel connector member 30. The bracket members 28 are respectively rigidly attached upon adjacent portions of the top edges 12B of the panels 12.

Each bracket member 28 includes an elongated generally planar mounting portion 32 and a pair of spaced flanges 34 integrally attached to opposite edges of the mounting portion 32. The flanges 34 project upwardly therefrom and extend longitudinally therealong. Also, a threaded upstanding stud 36 is affixed to the middle of each bracket member 28. Each bracket member 28 is generally U-shaped in cross-section with its flanges 34 extending in generally slightly tapered, but nearly parallel relation to one another and perpendicular relation to the mounting portion 30.

The connector member 30 of the panel top connector assembly 22 is adapted for an interference fit within and rigid attachment to the bracket members 28 so as to span therebetween and rigidly interconnect and automatically accurately align the panels 12 with one another. The connector member 30 includes an elongated generally planar mounting portion 38 and a pair of spaced flanges 40 integrally attached to opposite edges of the mounting portion 38. The flanges 40 project upwardly therefrom and extend longitudinally therealong. Also, the mounting portion 38 has a pair of longitudinally spaced openings 42 therein. The connector member 30 is generally U-shaped in cross-section with its flanges 40 extending in generally flared, divergent relation to one another.

Figure 8:
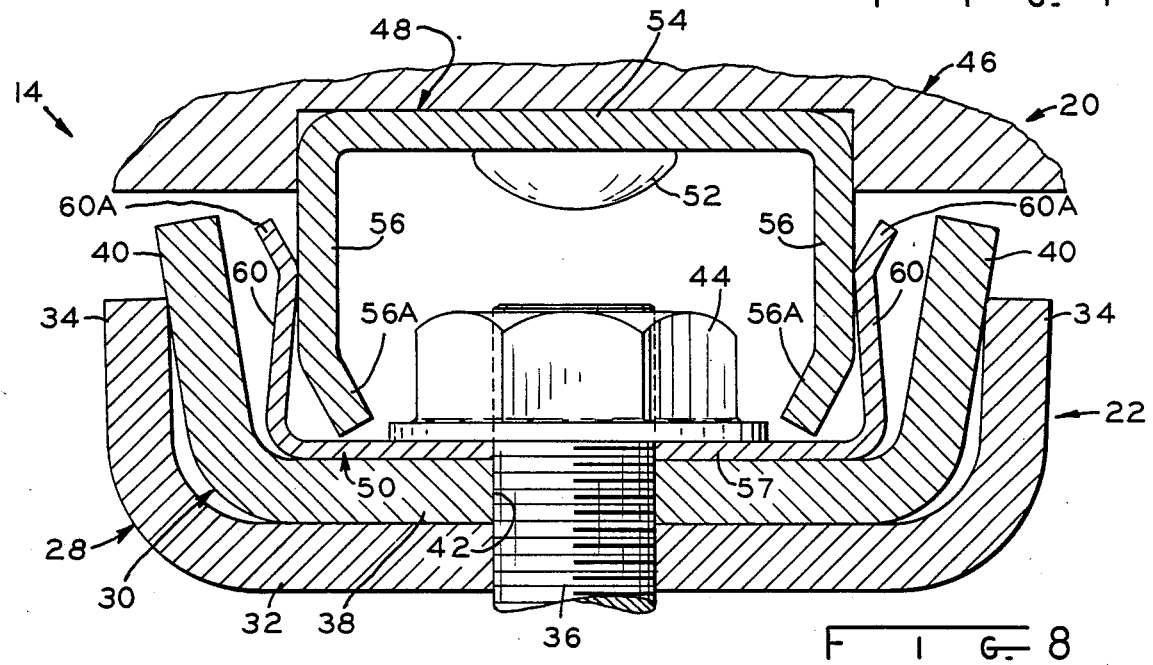
FIG. 8 is an enlarged cross-sectional view of a panel top cap assembly of the panel connection apparatus being associated with the top connector assembly of FIG. 2.

As best illustrated in FIG. 8, the spacing between the flanges 34 of each of the bracket members 28 is slightly less than between the flanges 40 of the connector member 30 such that when the connector member is inserted in a nested relation within the bracket members 28, the connector member flanges 40 are placed in an interference fit with the flanges 34 of the bracket members 28. Also, by inserting the threaded studs 36 of the bracket members 28 through the openings 42 in the connector member 30 and then threadably attaching a nut 44 on the stud 36, the connector member 30 will be drawn down between the flanges 34 of the bracket members 28 until its mounting portion 38 overlies the mounting portions 32 of the bracket members 28. The flanges 34, 40 of either one or both of the bracket members 28 and connector member 30 are resiliently yieldable for permitting yieldable flexing thereof to achieve insertion of the connector member 30 therein, frictional interengagement of the corresponding flanges 34, 40 with one another, and rigid attachment of the connector member 30 at its mounting portion 38 with the mounting portions 32 of the bracket members 28. The interference fit between flanges 34 and 40 results in an extremely rigid connection between adjacent panels 12 and ensures that the panels are aligned accurately so that there is no misalignment along the line of sight when looking down a row of interconnected panels 12.

Figure 6:
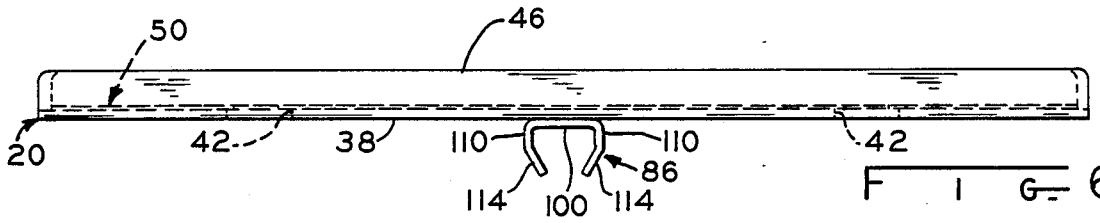
FIG. 6 is an enlarged side elevational view of a connector member used in a panel top connector assembly of the panel connection apparatus of FIG. 2.
Figure 7:
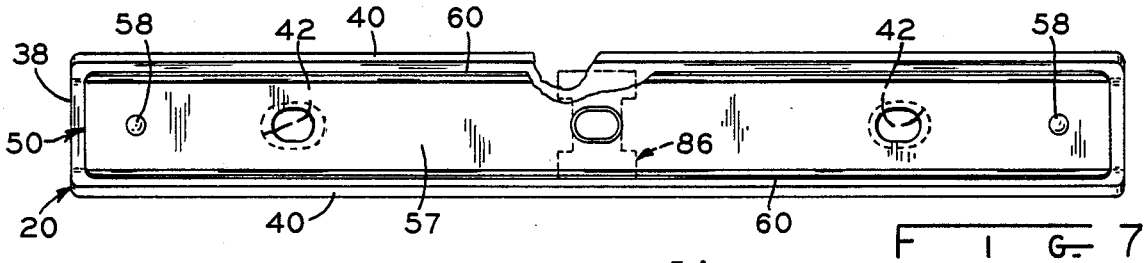
FIG. 7 is a top plan view, with parts broken away, of the connector member of FIG. 6.

Referring still to FIGS. 6–8, the panel top cap assembly 20 includes an elongated decorative cap member 46 (see also FIG. 1), a top cap retainer member 48, and a springable attachment member 50. The decorative cap members 46 are adapted to extend along and overlie adjacent portions of the top edges 12B of the panels 12. The top cap retainer members 48 are attached by fasteners 52 at mounting portions 54 to undersides of decorative cap members 46. The retainer members 48 each have a pair of spaced downwardly projecting flanges 56 which extend longitudinally of the retainer member 48 and are integrally connected to opposite edges of the mounting portion thereof.

The springable attachment member 50 of the top cap assembly 20 has a generally planar mounting portion 57 rigidly mounted by plug welds 58 to the upper side of the mounting portion 38 of the connector member 30. Also, the attachment member 50 has a pair of upwardly projecting flanges 60 extending longitudinally of the attachment member 50 and integrally connected to opposite sides of its mounting portion 54 and extending upwardly therefrom.

The flanges 60 of the attachment member 50 are capable of resiliently flexing away from one another for frictional interfitting with the flanges 56 of the retainer members 48 upon installation of the decorative cap members 46 along the top edges 12B of the panels 12 in overlying relation to the panel top edges and the connector member 30 thereon. More particularly, the lower edges 56A of the retainer member flanges 56 are generally in-turned, whereas the upper edges 60A of the attachment member flanges 60 are generally out-turned such that the respective edges 56A, 60A define cam surfaces which engage and cause yieldably flexing of the attachment member flanges 60 for achieving the frictional interfitting of the flanges 56, 60 with one another.

Figure 5:
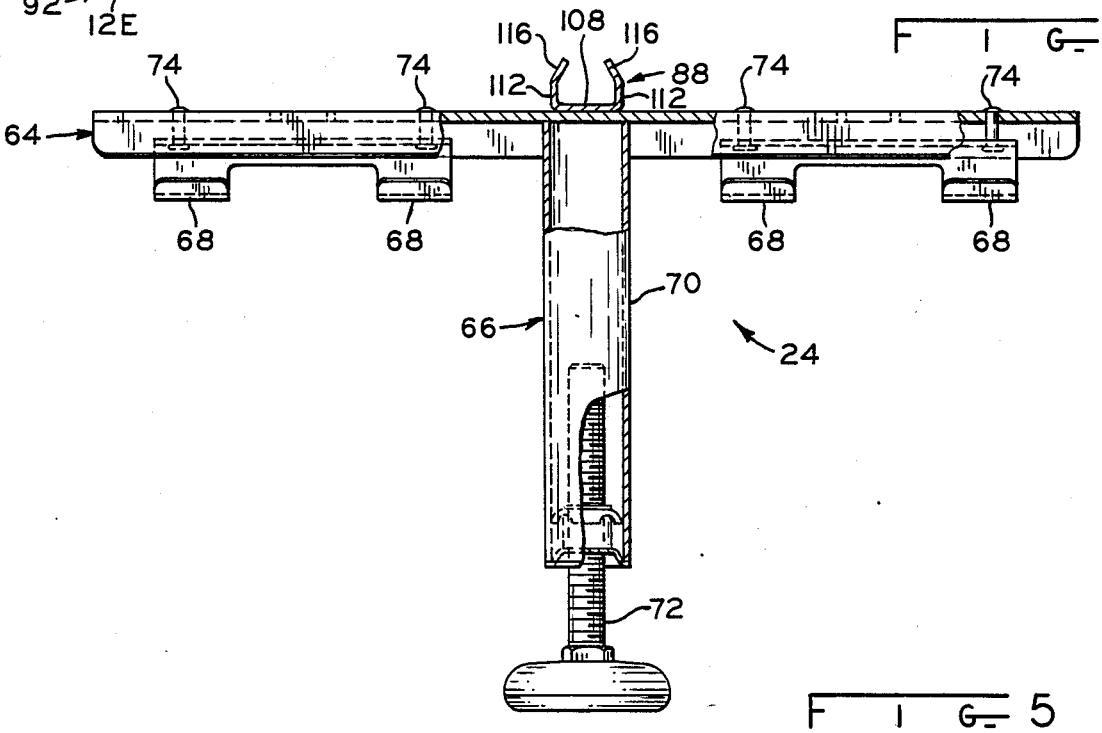
FIG. 5 is an enlarged side elevational view, with parts broken away, of a panel bottom connector assembly of the panel connection apparatus of FIG. 2.

Referring to FIGS. 2 and 5, the panel bottom connector assembly 24 of the panel attachment apparatus 14 includes a pair of panel bracket members 62 and a panel connector member 64 substantially identical in construction and function to the bracket members 28 and connector member 30 of the panel top connector assembly 24. A detailed description of these components of the bottom connector assembly 24 is set forth above. However, in addition to the similar bracket and connector members 28, 30, the bottom connector assembly 24 includes a pedestal 66 and a pair of wiring raceway cover hanger members 68 not found in the top connector assembly 22. The pedestal 66 is connected to the bottom connector member 64 and extends downwardly therefrom and includes a depending vertical leg tube 70 rigidly attached at a midway location to the underside of the bottom connector member 64 and an elongated glide 72 threadably adjustable relative to the tube 70 and thereby to the connector member 64. By rotating the glide 72, it will thread into the tube so that the level of the panels 12 connected together by the apparatus 10 can be set relative to the support surface.

The hanger members 68 of the panel bottom connector assembly are loosely slidably mounted by a plurality of spaced rivets 74 attached to and depending below the mounting portion of the bottom connector member 64. Openings 76 in the bottom connector member 64 are aligned with openings (not shown) in the hanger members 68. Thus, when threaded studs 78 on the bottom edges 12C of the panels are received through the openings and nuts 80 are tightened thereon to rigidly connect the bottom connector member 64 to the bottom bracket members 62, the nuts 80 also rigidly attach the hanger members 68 to the bottom connector member 64. If hanger members 68 are still loose when the wire raceway cover 69 is installed, this provides an indication to the installer that nuts 80 have not been sufficiently tightened to rigidly secure the entire assembly together.

Referring now to FIGS. 2–4, 9 and 10, the panel interlock assembly 26 of the panel connection apparatus 14 includes a pair of vertical channel members 82, 84 and a pair of top and bottom clamp members or brackets 86, 88. The vertical channel members 82, 84 are substantially identical to one another but are employed with one axially rotated 180 degrees relative to the other.

Each of the channel members 82, 84 is connected to one of the respective adjacent panel side edges 12D, 12E and is composed of interconnected walls 90, 92 which define first and second diagonally opposite right-angular corner portions 94, 96 and 98, 100 respectively. The first and second corner portions 94, 96 of the interconnected walls 90 of the one channel member 82 interfit respectively with the second and first corner portions 100, 98 of the other channel member 84 merely by moving the side edge 12D of one panel 12 toward the adjacent side edge 12E of the other panel 12. The channel members 82, 84 when interfitted together have a generally rectangular cross-sectional configuration and define a channel 102 therebetween being open at its top and bottom ends 102A, 102B.

Figure 9:
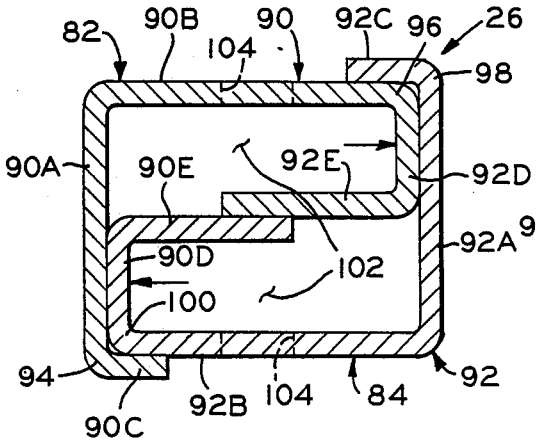
FIG. 9 is an enlarged top plan view of a pair of vertical channel members used in a panel interlock assembly of the panel connection apparatus of FIG. 2.
Figure 10:
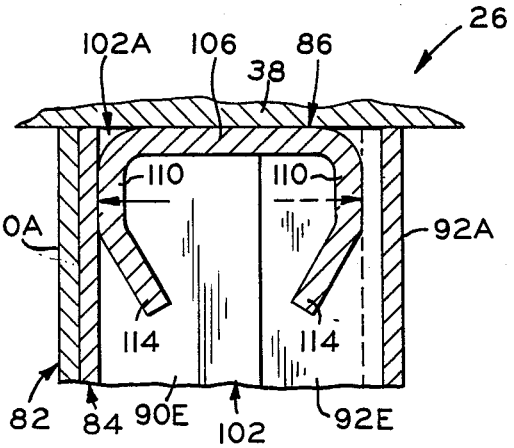
FIG. 10 is an enlarged cross-sectional view of an upper one of a pair of clamp members used in the panel interlock assembly of the panel connection apparatus of FIG. 2.

With the channel member corner portions 94, 96 and 98, 100 interfitted as seen in FIG. 9, the respective interconnected walls 90, 92 of the respective channel members 82, 84 define a first pair of spaced opposite walls 90A, 92A of the respective channel members 82, 84 at which they are connected to the panel side edges 12D, 12E and a second pair of spaced opposite walls 90B, 92B of the respective channel members 82, 84 extending at right angles to the walls 90A, 92A and between the panel side edges 12D, 12E. The channel 102 is defined by the first and second pairs of walls.

The first pair of spaced opposite walls 90A, 92A have right-angle edge flanges 90C, 92C respectively thereon which together with the walls 90A, 92A form the first corner portions 94, 98 of the interconnected walls 90, 92 of the channel members 82, 84. Each of the walls 90B, 92B of the second pair thereof of the channel members 82, 84 has a row of vertically spaced holes 104 defined therein for receiving a hanger (not shown) for supporting an object therefrom, such as the shelf 16 and work surface 18 (FIG. 1). The second pair of spaced opposite walls 90B, 92B also have L-shaped edge flanges 90D, 92D thereon which together with the walls 90B, 92B form the second corner portions 96, 100 of the interconnected walls 90, 92 of the channel members 82, 84. The second corner portions 96, 100 and the channel members 82, 84 respectively interfit inside of the first corner portions 98, 94, of the channel members. Further, the L-shaped edge flanges 90D, 92D on the walls 90B, 92B include respective middle walls 90E, 92E which extends generally across the middle of the channel 102 and overlap with one another so as to block passage of light through the holes 104 in the channel member walls 90B, 92B and across the channel 102 therebetween.

As seen in FIGS. 2 and 6, the top and bottom clamp brackets 86, 88 of the panel interlock assembly 26 are respectively attached to a bottom side of the connector member 30 of the top connector assembly 22 and a top side of the connector member 64 of the bottom connector assembly 24. The clamp brackets 86, 88 include bases 106, 108 and four springable fingers 110, 112 with in-turned tips 114, 116 projecting respectively downwardly and upwardly therefrom. The fingers 110, 112 of clamp brackets are spaced apart relative to the cross-sectional size of the channel 102 to tightly frictionally interfit within the respective open top and bottom ends 102A, 102B of the channel 102 defined by the assembled vertical channel members 82, 84 and engaged with at least one pair of the opposite corner portions 94, 96 and 98, 100 thereof for clamping and retaining the respective corner portions of the channel members 82, 84 at their respective interfitted relation with one another by forcing the channel members in the directions of the arrows in FIGS. 9 and 10.

It will be understood therefore that the connector members 30, 64 of the top and bottom connector assemblies 22, 24 serve to rigidly connect and accurately align the panels 12 with one another at their top and bottom four corner edges 12A, 12B. The channel members 82, 84 and clamp brackets 86, 88 of the interlock assembly 26 serve to augment the connection provided by the top and bottom connector assemblies 22, 24 by also pulling and holding the panels 12 together end to end at the adjacent sides 12D, 12E thereof. Thus, the primary function of these three assemblies 22, 24, 26 is to provide maximum rigidity and true alignment as well as pulling the panels 12 together. The vertical channel members 82, 84, when supporting other accessories in cantilevered fashion, are interlocked so as to resist the panels being pulled apart by the load. If the top connector member 30 is not properly installed, this will be visible because the top cap member 46 will not fit properly along the top edges of the panels.

Other advantages of the panel connection apparatus 14 described above as employed in the multi-panel system 10 alignment are as follows: 1. Set up and leveling of the panel system 10 is easier due to the use of a single leveling glide or pedestal at the panel joint by the bottom connector assembly 24. Most prior art panel systems utilize two leveling glides per panel which greatly increases the number of glides to level during installation. 2. The slotted walls of the vertical channel members 82, 84 are attached to the panel sides which reduces the number of parts associated with installation, and offers greater accuracy in the location of the slots relative to the panel. 3. The top and bottom connector assemblies are the same parts with the exception of the use of the top spring attachment member, the bottom pedestal and the raceway cover hanger members. 4. The interlock channel members have a "built-in" sight barrier that prevents light from passing from one side of the panels to the other through the panel "reveal" or gap. This feature eliminates the need of adding a blinder.

Substantially, the panel attachment apparatus 14 is used for connecting panels together to form corners except that channels 82 are disposed 90° apart on a corner post 85.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and falls within the limits of the appended claims.

What is claimed is:

1. In a panel connection apparatus for use in a multi-panel system including at least a pair of panels each having a frame structure with top and bottom edges and opposite side edges, a panel top cap assembly of said panel connection apparatus comprising:

at least one elongated decorative cap member adapted to extend along and overlie adjacent portions of the top edges of the panels;

at least one top cap retainer member attached to said decorative cap member;

a connector member adapted for attachment to the pair of panels at the adjacent portions of their top edges so as to span between the panels and rigidly interconnect the panels;

a pair of panel bracket members attached to the adjacent portions of said pair of panels, each of said bracket members including a pair of spaced flanges projecting upwardly, said connector member being received within said spaced flanges of each said bracket member in an interference fit with said spaced flanges; and said connector member including an attachment member, one of said attachment and top cap retainer members including means whereby it is capable of resiliently yieldably flexing away from the other of said attachment and top cap retainer members for frictional interfitting of said attachment and retainer members upon installation of said decorative cap member along the top edges of the panels in overlying relation to the panel top edges and said connector member thereon.

2. The connection apparatus as recited in claim 1 wherein said top cap retainer member includes a pair of spaced downwardly projecting flanges extending longitudinally of said cap retainer member.

3. The connection apparatus as recited in claim 2 wherein said top cap retainer member is generally U-shaped in cross-section.

4. The connection apparatus as recited in claim 2 wherein said attachment member includes a pair of upwardly projecting flanges extending longitudinally of said attachment member.

5. The connection apparatus as recited in claim 4 wherein said attachment member is generally U-shaped in cross-section.

6. In a panel connection apparatus for use in a multipanel system including at least a pair of panels each having a frame structure with top and bottom edges and opposite side edges, a panel connector assembly comprising:

a pair of panel bracket members attached to adjacent portions of one of said top and bottom edges of the panels, each of said panel bracket members including an elongated mounting portion and a pair of spaced flanges attached to said mounting portion and projecting upwardly therefrom and extending longitudinally therealong; and a panel connector member means rigidly connected to said panel bracket members and spanning between said bracket members to rigidly interconnect and accurately align the panels with one another, said panel connector means having an interference fit with said panel bracket members.

7. The connection apparatus as recited in claim 6 wherein said each panel bracket member is generally U-shaped in cross-section with said flanges thereof extending in generally parallel relation to one another.

8. The connection apparatus as recited in claim 7 wherein said panel connector member means includes an elongated mounting portion and a pair of spaced flanges integrally attached to opposite edges of said mounting portion and projecting outwardly therefrom and extending longitudinally therealong.

9. The connection apparatus as recited in claim 8 wherein said panel connector member is generally U-shaped in cross-section with said flanges thereof extending in generally flared, divergent relation to one another, said panel connector member being adapted to insert in a nested relation within said panel bracket members with said connector member flanges in said interference fit with said flanges of said bracket members.

10. The connection apparatus as recited in claim 9 wherein said connector member mounting portion is rigidly connected to said mounting portions of said bracket members.

11. The connection apparatus as recited in claim 6 wherein said bracket member flanges diverge and said panel connector means is received within said spaced flanges in an interference fit with said spaced flanges.

12. The connection apparatus as recited in claim 11 wherein one of said connector member flanges and said bracket member flanges are resiliently yieldable for permitting yieldable flexing of said one flanges to achieve insertion of said connector member means and said frictional interengagement of said flanges with one another.

13. The connection apparatus as recited in claim 6 further comprising a pair of said panel connector assemblies respectively located at the top and bottom edges of the panels for spanning between said panels and, interconnecting and aligning said panels at the top and bottom edges thereof.

14. The connection apparatus as recited in claim 13 wherein said panel connector assembly at the bottom edges of the panels includes a pedestal coupled to said connector member and extending downwardly therefrom for engaging a support surface, said pedestal being adjustable relative to said connector member for leveling the panels relative to the support surface.

15. In a panel connection apparatus for use in a multipanel system including at least a pair of generally planar panels each having a frame structure with top and bottom edges and opposite side edges, a panel interlock assembly comprising: a pair of vertical channel members each being connected to one of the respective adjacent panel side edges and having interconnected walls defining respective first and second diagonally opposite corner portions, said first and second corner portions of one channel member being slidably interfittable with said second and first corner portions of the other channel member by moving the side edge of one panel toward the adjacent side edge of the other panel in a direction coplanar with said panels, said channel members when interfitted together defining a channel therebetween being open at its top and bottom ends; and a pair of clamp means for interfitting within said respective open top and bottom ends of said channel defined by said channel members and engaging said channel members for clamping and retaining said respective corner portions of said channel members at their respective interfitted relation with one another.

16. The connection apparatus as recited in claim 15 wherein said respective interconnected walls when said channel member corner portions are interfitted together are configured to define a first pair of spaced opposite walls of said respective channel members at which said respective channel members are connected to the panel side edges and a second pair of spaced opposite walls of said respective channel members which extend between the panel side edges, said first and second pairs of walls defining said channel therebetween being open at its top and bottom ends.

17. The connection apparatus as recited in claim 16 wherein each of said walls of said second pair thereof of said channel members has a row of holes defined therein for receiving a hanger for supporting an object therefrom.

18. The connection apparatus as recited in claim 17, wherein said channel members includes respective middle walls which extend generally across the middle of said channel and overlap with one another so as to block passage of light through said holes in said channel members and across said channel therein.

19. The connection apparatus as recited in claim 15 wherein said second corner portions of the one and the other of said channel members respectively interfit inside of said first corner portions of said other and one of said channel member.

20. The connection apparatus as recited in claim 15 wherein said clamp means each comprises a pair of finger means insertable in said channel for urging said channel members in opposite directions to thereby clamp corner portions of said respective channel members together.

21. The panel connection apparatus as recited in claim 20 wherein said fingers include cam surfaces to facilitate insertion into said channel.

22. In a multi-panel system including at least a pair of panels each having a frame structure with top and bottom edges and opposite side edges, a panel connection apparatus comprising:

a panel top connector assembly including (i) a pair of panel bracket members attached on adjacent portions of the top edges of the panels, and (ii) a panel connector member adapted for interference interengagement within and rigid attachment to said panel bracket members so as to span therebetween and rigidly interconnect and accurately align the panels with one another;

a panel top cap assembly including (i) at least one elongated decorative cap member adapted to extend along and overlie adjacent portions of the top edges of the panels, (ii) at least one top cap retainer member attached to an underside of said decorative cap member and having a pair of spaced downwardly projecting flanges extending longitudinally of said cap retainer member, and (iii) an attachment member mounted to said connector member of said top connector assembly, one of said attachment and top cap retainer members being capable of resiliently yieldably flexing away from the other for frictional interfitting together upon installation of said decorative cap member along the top edges of the panels in overlying relation to the panel top edges and said connector member thereon;

a panel bottom connector assembly including (i) a pair of panel bracket members attached on adjacent portions of the bottom edges of the panels, (ii) a panel connector member adapted for frictional interengagement within and rigid attachment to said panel bracket members so as to span therebetween and rigidly interconnect and accurately align the panels with one another, and (iii) a pedestal coupled to said connector member and extending downwardly therefrom for engaging a support surface, said pedestal being adjustable relative to said connector member for leveling the panels relative to the support surface;

a panel interlock assembly including (i) a pair of vertical channel members each being connected to one of the respective adjacent panel side edges and having interconnected walls defining respective first and second diagonally opposite corner portions, said first and second corner portions of one channel member being interfittable with said second and first corner portions of the other channel member by merely moving the side edge of one panel toward the adjacent side edge of the other panel, (ii) said respective interconnected walls when said channel member corner portions are interfitted together defining a first pair of spaced opposite walls of said respective channel members at which said respective channel members are connected to the panel side edges and a second pair of spaced opposite walls of said respective channel members which extend between the panel side edges, said first and second pairs of walls defining a channel therebetween being open at its top and bottom ends, and (iii) a pair of clamp means, one being attached to a bottom side of said connector member of said top connector assembly and projecting downwardly therefrom and the other being attached to a top side of said connector member of said bottom connector assembly and projecting upwardly therefrom, said clamp means being interfittable within said respective open top and bottom ends of said channel defined in said vertical channel members and engaged with at least one pair of the opposite corner portions thereof for clamping and retaining said respective corner portions of said channel members at their respective interfitted relation with one another.

23. The connection apparatus as recited in claim 22, wherein said top cap retainer member includes a pair of spaced downwardly projecting flanges extending longitudinally of said cap retainer member.

24. The connection apparatus as recited in claim 23 wherein said top cap retainer member is generally U-shaped in cross-section.

25. The connection apparatus as recited in claim 23 wherein said attachment member includes a pair of upwardly projecting flanges extending longitudinally of said attachment member.

26. The connection apparatus as recited in claim 25 wherein said attachment member is generally U-shaped in cross-section.

27. The connection apparatus as recited in claim 25 wherein lower edges of said retainer member flanges are generally in-turned and upper edges of said attachment member flanges are generally out-turned such that said respective edges define cam surfaces which engage and cause yieldable flexing of the flanges of the resiliently flexible one of said retainer and attachment members for achieving said frictional interfitting of said flanges with one another.

28. The connection apparatus as recited in claim 22 wherein each of said panel bracket members of said top and bottom connector assemblies includes an elongated mounting portion and a pair of spaced flanges integrally attached to opposite edges of said mounting portion and projecting outwardly therefrom and extending longitudinally therealong.

29. The connection apparatus as recited in claim 28 wherein said each panel bracket member is generally U-shaped in cross-section with said flanges thereof extending in generally parallel relation to one another.

30. The connection apparatus as recited in claim 28, wherein said panel connector member of each of said top and bottom connector assemblies includes an elongated mounting portion and a pair of spaced flanges integrally attached to opposite edges of said mounting portion and projecting outwardly therefrom and extending longitudinally therealong.

31. The connection apparatus as recited in claim 30 wherein said panel connector member is generally U-shaped in cross-section with said flanges thereof extending in generally flared, divergent relation to one another, said panel connector member being adapted to insert in a nested relation within said panel bracket members with said connector member flanges in said frictional interengagement with said flanges of said bracket members.

32. The connection apparatus as recited in claim 30 wherein said connector member mounting portion is adapted for rigid connection to said mounting portions of said bracket members.

33. The connection apparatus as recited in claim 30 wherein one of said connector member flanges and said bracket member flanges are resiliently yieldable for permitting yieldable flexing of said one flange to achieve insertion of said connector member and said frictional interengagement of said flanges with one another.

34. The connector apparatus as recited in claim 22 wherein said panel bottom connector assembly includes a pair of wiring raceway hanger members being loosely connected to said connector member and adapted to be rigidly connected thereto only upon rigid attachment of said connector member to said bracket members of said bottom panel connector assembly.

35. The connection apparatus as recited in claim 22 wherein each of said walls of said second pair thereof of said channel members has a row of holes defined therein for receiving a hanger for supporting an object therefrom.

36. The connection apparatus as recited in claim 35 said channel members include respective middle walls which extends generally across the middle of said channel and overlap with one another so as to block passage of light through said holes in said channel members and across said channel therein.

37. The connection apparatus as recited in claim 22 wherein said second corner portions of the one and the other of said channel members respectively interfit inside of said first corner portions of said other and one of said channel member.

38. In a panel connection apparatus for use in a multipanel system including at least a pair of panels each having a frame structure with top and bottom edges and opposite side edges, a panel top cap assembly of said panel connection apparatus comprising:

at least one elongated decorative cap member adapted to extend along and overlie adjacent portions of the top edges of the panels;

at least one top cap retainer member attached to an underside of said decorative cap member;

a connector member adapted for attachment to the pair of panels at the adjacent portions of their top edges so as to span between the panels and rigidly interconnect the panels;

said connector member including an attachment member, one of said attachment and top cap retainer members including means whereby it is capable of resiliently yieldably flexing away from the other of said attachment and top can retainer members for frictional interfitting of said attachment and retainer members upon installation of said decorative cap member along the top edges of the panels in overlying relation to the panel top edges and said connector member thereon, said attachment member including a pair of upwardly projecting flanges extending longitudinally of said attachment member; and lower edges of said retainer member flanges being generally in-turned and upper edges of said attachment member flanges being generally out-turned such that said respective edges define cam surface which engage and cause yieldable flexing of the flanges of the resiliently flexible one of said retainer and attachment members for achieving said frictional interfitting of said flanges with one another.

39. In a panel connection apparatus for use in a multipanel system including at least a pair of panels each having a frame structure with top and bottom edges and opposite side edges, a pair of panel connector assemblies respectively located at the top and bottom edges of the panels for spanning between said panels and interconnecting and aligning said panels at the top and bottom edges thereof, each of said panel connector assemblies comprising:

a pair of panel bracket members attached to adjacent portions of respective top or bottom edges of the panels; and a panel connector means rigidly connected to adjacent said panel bracket members of the pair and spanning between said bracket members to rigidly interconnect and accurately align the panels with one another, said panel connector means having an interference fit with the respective panel bracket members;

said panel connector assembly at the bottom edges of the panels including a pair of wiring raceway hanger members being loosely connected to the bottom edge connector means and including means for rigidly connecting said hanger members to said lower edge connector means only upon rigid attachment of said lower edge connector means to said bracket members of said bottom panel connector assembly.

40. In a panel connection apparatus for use in a multipanel system including at least a pair of panels each having a frame structure with top and bottom edges and opposite side edges, a panel connector assembly comprising:

a pair of panel bracket members attached to adjacent portions of one of said top and bottom edges of the panels; and a panel connector means rigidly connected to said panel bracket members and spanning between said bracket members to rigidly interconnect and accurately align the panels with one another, said panel connector means having an interference fit with said panel bracket members, one of said bracket members and connector member means including spaced tapered flange members that are received in spaced flange members of the other of said bracket embers and connector means.

* * * * *